United States Patent [19]

Brown et al.

[11] 3,958,697

[45] May 25, 1976

[54] LEVELING AND UPWARDLY ELEVATING APPARATUS FOR REINFORCED PERFORATE TAGS

[76] Inventors: Richard L. Brown, 1812 Pelton Ave., Bellevue, Nebr. 68005; Warren R. Nohrenberg, 9229 Fowler St., Omaha, Nebr. 68134

[22] Filed: Feb. 14, 1975

[21] Appl. No.: 550,143

[52] U.S. Cl. ..... 211/54; 211/49 D

[51] Int. Cl.[2] ..... A47F 1/06

[58] Field of Search ..... 211/49 D, 49 S, 54, 211/57, 59; 402/70, 72, 80 R; 221/312 A

[56] References Cited

UNITED STATES PATENTS

| | | | |
|---|---|---|---|
| 706,630 | 8/1902 | Allen | 211/57 |
| 937,071 | 10/1909 | Huber | 211/54 X |
| 1,187,541 | 6/1916 | Muller | 221/312 A |
| 1,382,523 | 6/1921 | McMillan | 402/70 |
| 1,711,070 | 4/1929 | Suydam | 211/57 X |
| 2,126,980 | 8/1938 | Sears et al. | 211/57 X |
| 2,433,748 | 12/1947 | Eide | 108/101 |
| 3,291,544 | 12/1966 | Ord | 211/49 D X |
| 3,349,775 | 10/1967 | Rubissow | 211/54 X |
| 3,533,511 | 10/1970 | Giampa | 211/54 X |
| 3,696,937 | 10/1972 | Braverman | 211/54 |

FOREIGN PATENTS OR APPLICATIONS

| | | | |
|---|---|---|---|
| 784,818 | 10/1957 | United Kingdom | 211/49 D |

*Primary Examiner*—Roy D. Frazier
*Assistant Examiner*—Thomas J. Holko
*Attorney, Agent, or Firm*—George R. Nimmer

[57] ABSTRACT

Reinforced perforate tags ordinarily comprise a longitudinally semi-flexible cellulosic or other sheet material card together with a geometrically-offset perforation reinforced with grommet or eyelet to provide the composite tag's thickest part. Because natural stacking of such offset reinforced tags is impractical, system users thereof such as printers, laminaters, etc., are impeded or otherwise handicapped in their repetitive work. However, a uniquely positioned upright elongate-rod extending obliquely upwardly and slidably through theh respective reinforced perforations tiltably forces the individual tags'card main body into parallelism. With the aid of an upright abutment-plate having a frontal-face lying parallel to the elongate-rod plane and together with gradual upward elevation for the tags stack, successive uppermost tags are made readily available at constant-elevation for systems type users such as automatic printers, laminaters, etc.

7 Claims, 6 Drawing Figures

FIG. 1
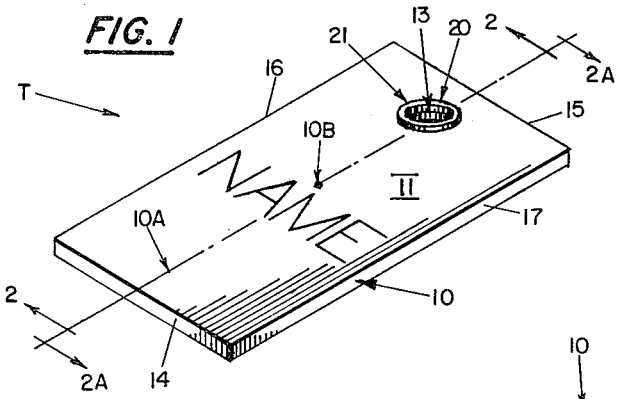
FIG. 2
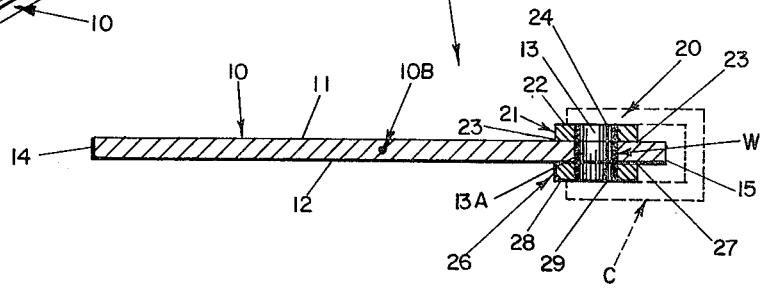
FIG. 3
PRIOR ART
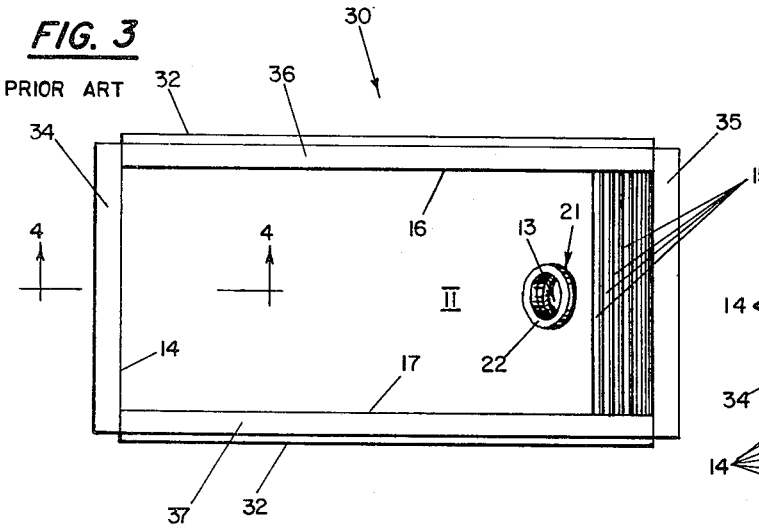
FIG. 4
PRIOR ART
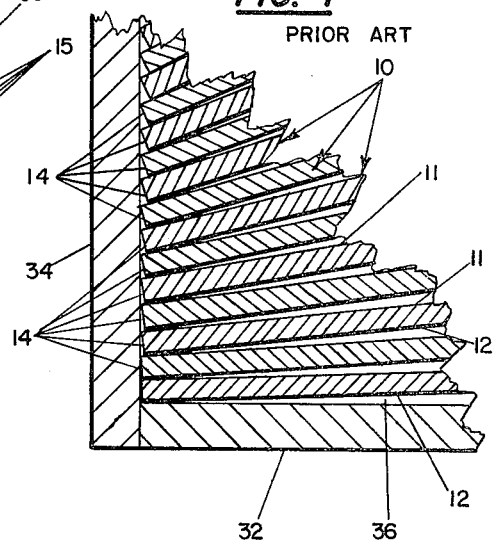
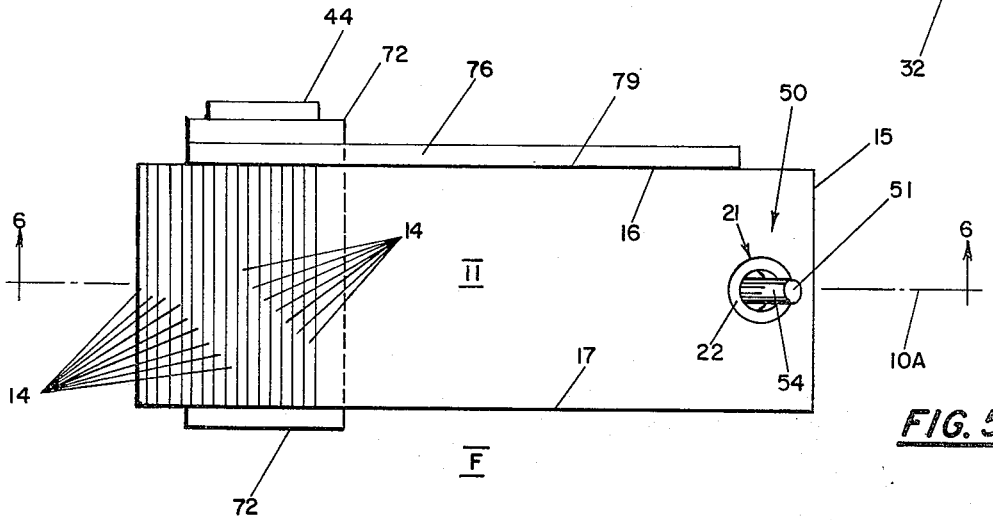
FIG. 5

LEVELING AND UPWARDLY ELEVATING APPARATUS FOR REINFORCED PERFORATE TAGS

So-called "reinforced tags" are ordinarily defined to mean a longitudinally elongate and semi-flexible sheet material (e.g. cellulosic) card-like main body and also having a geometrically-offset perforation reinforced with grommet, eyelet, etc. Because the geometrically-offset reinforced perforation is dimensionally thicker than the card main body, such tags are not ordinarily amenable to laminarly parallel upright stacking. For example, the stack tends to shift longitudinally away from the thicker reinforced perforation and the higher elevation semi-flexible tags assume a progressively more oblique posture. Accordingly, uprightly stacked tags are usually not amenable to systematic feeding usage, such as rapidly feeding the successive uppermost tag to printing presses, adhesion or attachment laminaters, etc. Thus, tedious manual feeding of the uppermost tag is resorted to which impedes or otherwise handicaps systematic conversion of the stacked tags. For example, plagueing the printing industry is the necessity for tediously manually feeding the tags to the printing press.

It is accordingly the general object of the present invention to provide leveling and upward elevating assembly for reinforced offset-perforate tags which makes the tags sufficiently parallel and progressively upwardly movable and therefore amenable to systematic feeding, such as into a printing press, laminating machine, etc.

With the above and other ancillary objects and advantages in view, which will become more apparent as this description proceeds, the leveling and upward elevating apparatus for upwardly extending stacks of reinforced perforate tags generally comprises a uniquely positioned upright elongate-rod passing slidably through the respective reinforced perforations and lying markedly oblique to forceably tilt the several tags into parallelism along their card-like main body portions, an upright abutment-plate having a frontal-face lying parallel to the elongate-rod and abutting a lineal sideward-edge of the respective tags' card-like main body, and upward elevation means to maintain the uppermost tag at contant-elevation for withdrawable rapid feeding.

In the drawing, wherein like characters refer to like parts in the several views, and in which:

FIG. 1 is a perspective view of a typical reinforced perforate tag which is amenable for stacking use with the leveling and upward feeding concepts of the present invention.

FIG. 2 is a longitudinally extending sectional elevational view taken along line 2—2 of FIG. 1, FIG. 2A-2A (not shown) being a substantial mirror image thereof, FIG. 2 showing the semi-flexible nature of the tag's card-like main body portion.

FIG. 3 is a top plan view of the FIGS. 1 and 2 tag shown in uprightly extending stackwise form and within a conventional opentop upright box-like housing of the prior art.

FIG. 4 is a sectional elevational view taken along line 4—4 of FIG. 3.

FIG. 5 is a top plan view of a representative embodiment of the leveling and upwardly elevating apparatus of the present invention and including an upwardly extending stack of reinforced cards (e.g. FIGS. 1 and 2) used in withdrawably feedable conjunction therewith.

Figure 6:
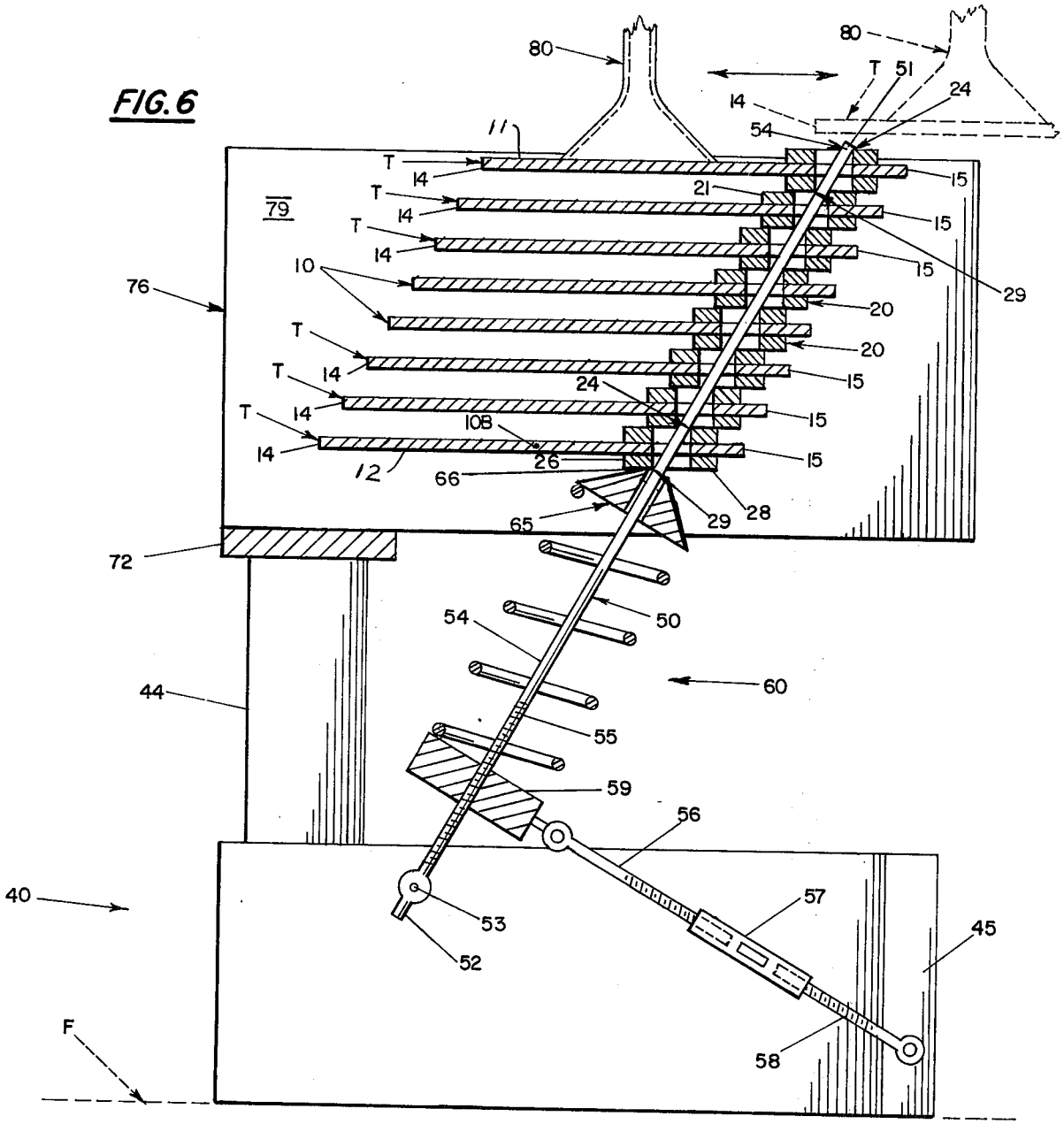
FIG. 6 is a longitudinally extending sectional elevational view taken along line 6—6 of FIG. 5.

Turning initially to FIGS. 1 and 2 which depict a typical embodiment of reinforced perforate tag "T." Tag T conventionally comprises a semi-flexible sheet material card-like main body (10) extending along longitudinal central-axis 10A and being of regular thickness between the parallel broad horizontal surfaces thereof e.g. top-surface 11 and bottom-surface 12. Geometrically-offset from the main body geometric center 10B is a vertical perforation (herein circular) 13 extending between broad surfaces 11 and 12. The card-like main body (10) has a plurality of peripheral edges including a remote transverse free-edge (14) located most remote of the offset perforation 13 and at least one longitudinally extending lineal sideward-edge (16). For the rectangular cellulosic card 10 shown, there are four lineal peripheral edges including a pair of lineal longitudinal sideward-edges 16 and 17 (both parallel to central-axis 10A) and a pair of parallel lineal transverse edges 14 and 15. There are also structural reinforcement means (20) for the main body's geometrically-offset perforation (13), herein the reinforcement means being the grommet type comprising a pair of circular uniplanar annular discs i.e. upper-disc 21 and lower-disc 26. Upper-disc 21 has a pair of opposed parallel circularly annularly horizontal planar surfaces including upper-face 22 and lower-face 23 (adhered to main body top-surface 11) and a vertical circular inside-wall 24. Lower-disc 26 similarly includes a pair of opposed parallel circularly annularly horizontal planar faces including upper-face 27 (adhered to main body bottom-surface 12) and lower-face 28 and a vertical circular inside-wall 29. It can be seen that the grommets' circular inside-walls 24 and 29 and the card perforation-wall 13A together lie along a common linearly generated effective-wall which might be called "W" (i.e.24,13A,and 29).

It is readily apparent from FIG. 2 that the reinforced (20) perforation (13) is the thickest part of the aggregate tag (T). Moreover, FIG. 2 indicated the levelability configuration of the sheet material card-like main body 10 if a C-clamp ("C" in phantom line) were employed to securely grasp the perforation reinforcement (e.g. grommets 21 and 26) of an individual tag e.g. T.

FIG. 3 depicts a rectangular open-top box-like receptacle 30 comprising a horizontal bottom-panel 32 from which vertically upwardly extend four interconnected sturdy vertical-panels including the longitudinal and parallel panels 36 and 37 and also including transverse left-panel 34 and its co-parallel transverse right-panel 35. The transverse distance between the open-top recetacle's longitudinal panels 36 and 37 is equivalent to the transverse distance between each card's longitudinal sideward-edges 16 and 17, and the tags T will upwardly laminarly stack within box 30, as is well known in the prior art. However, as is also well known in the prior art, inasmuch as the thickest part of each tag T is at the card perforation reinforcement 20 (e.g. 21 and 26), the tags T will inherently shift longitudinally away from the reinforcements (20) whereby the respective remote transverse free-edges (14) will each abut against transverse left-panel 34. Thus, in top plan view, nearby transverse free-edges (15) of cards 10 will be seen in longitudinally extending stepwise fashion (FIG. 3). Accordingly, as seen in FIG. 4, higher elevation reinforced-perforation tags T assume a progressively more oblique (i.e. non-parallel) relationship to underlying tags T and to box bottom-panel 32. It is well known in the prior art that these longitudinal shifty phenomena make systematic feeding of tags exceedingly difficult.

Referring now to FIGS. 5 and 6, a uniquely positioned uniplanar elongate-rod (50) and having upper-end (51) extends markedly obliquely and slidably through the reinforced (20) perforations (13) of the respective tags T. The said oblique-rod (50) forceably bears against the reinforced effective-wall (W) and thereby forceably tilts the several tags T to lie substantially parallel to each other. Uniplanar elongate-rod as embodiment 50 is predominately (and herein entirely) linear from its upper-end 51 to its lower-end 52. In FIG. 6 elevational view, linear elongate-rod 50 (which is of sturdy and regular circular cross-sectional shape) can be seen to have a pair of longitudinally-separated linear bearing-sides 54 and 55 forceably bearing against vertically-separated distinct locations of each tag's effective-wall W. For example, bearing-side 55 forceably bears cornerwise against the upper-disc inside-wall 24 (without touching lower-disc 26). However, the opposite bearing-side 54 forceably bears against the lower-disc inside-wall 29 (without touching upper-disc 21). Elongate-rod upper-end 51 is located in elevation slightly above the uppermost stacked tag T, while lower-end 52 is located in elevation well below the lowermost identical tag. Thus, in direct counterdistinction to the prior art situation (FIGS. 3 and 4), it is the remote transverse-edge (14) of the stacked tags which is seen longitudinally stepwise in top plan view (FIG. 5). Desireably, the obliqueness of elongate-rod 50 is established to maintain the several tag cards (10) horizontal. In this vein, there are means to selectively establish and maintain the angularity for the elongate-rod (50). Such means might take the form of a conventional turnbuckle fitting (56–58) connected between a collar 59 which is threadedly engaged to elongate-rod 50, the lower-end 52 herein being pivotably attached with transverse-pin 53 to a base member 40. The base member is adapted to stably rest upon a suitable underlying substrate (e.g. horizontal flooring "F"). The threaded stud part 58 of the turnbuckle is herein pivotably attached to the base transverse flange 45.

For elongate-rods having non-planar bearing-sides (e.g. circular cross-section rod 50), there is necessarily an upright abutment-plate (e.g. 76) for maintaining the individual slidably stacked tags in substantial overlying aligned registry (e.g. FIG. 5 top plan view). In this vein, the upright abutment-plate (e.g. 76) has a broad planar abutting-face (e.g. 79) which abuts a geometrically similar lineal peripheral-edge of the respective tag cards (10). Herein selected for abuttment by planar abutting-face 79 is the longitidinal lineal sideward-edge 16 of each tag T. Upright abutment-plate 76 extends rigidly upwardly of the base means upright column 44, there being the intervening horizontal-panel 72 (alkin to bottom-panel 32). Thus, uniplanar elongate-rod 50 is parallel to the longitudinally extending abutting-face 79 of upright abutment-plate 76.

There are upward elevation means actuatably extending upwardly from the stationary base means (40) to the slidably stacked tags T to maintain the uppermost tag at substantially constant elevation for systematic withdrawable feeding (e.g. 80). Herein employed for the upward elevation means is a helical compressed spring 60 conforming to Hooke's Law, which spring 60 loosely surrounds elongate-rod 50 and has its lower end bearing downwardly against stationary collar 59. The upper end of compressed helical spring 60 bears upwardly at constant force against the composite gravimetric force of the stacked tags T. There is an underlying support for the lowermost slidably stacked tag to maintain it and successively higher tags T in parallelism. With the grommet type (21,26) reinforcement means (20), the underlying support (e.g. 65) provides firmly flatly abutting contact between neighboring tags (e.g. at abutting horizontal planar faces 22 and 28) whereby tags T are horizontal as well as parallel. A rudimentary underlying support means comprises a conical washer 65 slidably surrounding elongate-rod 50 and having a corner 66 liftably bearing against grommet lower-disc 26 by virtue of spring 60.

Thus, the uppermost tag T (irrespective of the number of tags within the slidable stack) is urged to substantially constantelevation whereby systematic withdrawable feeding (e.g. 80) is promoted. For example, a vacuumatic feeder 80 is adapted from external mechanism (not shown) to reciprocate longitudinally and upwardly from its solid to phantom line conditions (double-headed oblique arrow) to automatically withdrawably feed the uppermost tag to a suitable converter e.g. printing press, laminating machine, baggage tagging, etc. It is also possible to provide sensing means (not shown), such as wandswitch, photoelectric cell, etc., along an edge of uppermost cards to augment the operability for the selected type upward elevation means.

From the foregoing, the construction and operation of the leveling and elevating apparatus will be readily understood and further explanation is believed to be unnecessary. However, since numerous modifications and changes in the general concept will readily occur to those skilled in the art, it is not desired to limit the invention to the exact construction shown and described, and accordingly, all suitable modifications and equivalents may be resorted to, falling within the scope of the appended claims.

We claim:

1. Leveling and upward elevating assembly for and including an upwardly extending stack of identical perforation-reinforced tags including an uppermost tag and a lowermost tag, said individual tags being of identical geometric size and shape and gravimetric weight and comprising a longitudinally semi-flexible sheet material card main body and also a geometrically-offset reinforceably-surrounded perforate portion reinforced structurally by surrounding grommet, eyelet, or the like, whereby said structurally reinforceably-surrounded perforate portion provides the tag's thickest part, each said semi-flexible card having at least two peripheral edges including a transversely extending remote free-edge located most remote from the reinforced perforation and a longitudinally extending lineal sideward-edge, said leveling and upward elevation assembly including the stacked tags comprising:

A. a stationary underlying base means adapted to stably rest upon a suitable horizontal substrate;

B. an upright uniplanar elongate-rod extending obliquely upwardly from the base means and said horizontal substrate and loosely slidably passing through the reinforceably-surrounded perforation of each card, the elongate-rod upper-end being loftily elevated above the base means and slightly above the uppermost tag of the slidable stack, opposite bearing-sides of the elongate-rod forceably tiltably bearing against vertically-separated locations of the reinforceably-surrounded perforation of each tag thereby creating a horizontal and parallel relationship among the several semi-flexible cards and a spatial-gap also created between the remote free-edge of the cards, said oblique elongate-rod lying substantially parallel to that common upright-plane defined by the lineal sideward-edge of the several stacked cards and whereby in top plan view the geometrically similar free-edge of each of the stacked cards is visually discernible in stepwise array; and C. upward elevation means actuatably upwardly extending from the base means to the lowermost tag's perforation reinforcement to maintain the uppermost of the slidably stacked parallel cards at a substantially constant elevation which is slightly below the elongate-rod upper-end.

2. The leveling and elevating apparatus of claim 1 wherein an upright abutment-plate is attached to and extends upwardly from the base means, said abutment-plate having a longitudinally extending abutting-face abutting against the lineal sideward-edge of the several stacked tags and lying parallel to the uniplanar elongate-rod.

3. The leveling and elevating apparatus of claim 2 wherein the major proportion of the uniplanar elongate-rod is continuously linear and of circular cross-sectional shape; wherein longitudinally separated opposite bearing-sides of the elongate-rod tiltably bear against the vertically-separated locations of the perforation reinforcement of each tag; and wherein in top plan view the remote free-edge of the several slidably stacked horizontal cards is visually discernible in stepwise fashion progressing in the longitudinal direction away from the elongate-rod.

4. The leveling and elevating apparatus of claim 3 wherein the upward elevation means includes an underlying support for the lowermost stacked tag.

5. The leveling and elevating apparatus of claim 4 wherein each tag comprises a circular perforation encircled by two circular grommets lying flatly along and adherently attached to the two opposed broad surfaces of the semi-flexible card main body; wherein the elongate-rod is structurally rigid and restrainined at its lower-end from movement in the transverse direction; wherein the several tags are forced into horizontal condition by the elongate-rod whereby the circular disc-like grommets of neighboring tags flatly abut each other; and wherein the underlying support means slidably surrounds the elongate-rod and liftably bearing against the lowermost tag.

6. The leveling and elevating apparatus of claim 2 wherein each tag comprises a circular perforation encirced by two circular grommets lying flatly along and adherently attached to the two opposed broad surfaces of the semi-flexible card main body; wherein the elongate-rod is structurally rigid and restrained at its lower-end from movement in the transverse direction; and wherein the several tags are forced into substantially horizontal condition by the oblique elongate-rod whereby the circular disc-like grommets of neighboring tags flatly abut each other.

7. The leveling and elevating apparatus of claim 6 wherein the major proportion of the uniplanar elongate-rod is continuously linear and of circular cross-sectional shape; wherein longitudinally separated opposite bearing-sides of the elongate-rod tiltably bear against the vertically separated grommets of each tag; wherein in top plan view the remote free-edge of the several slidably stacked tags is visually discernible as a stepwise array progressing in the longitudinal direction away from the elongate-rod; and wherein the upward elevation means includes an underlying support slidably surrounding the elongate-rod and liftably bearing against the lowermost tag's underside grommet.

* * * * *